United States Patent [19]

Thomas

[11] Patent Number: 4,555,183

[45] Date of Patent: Nov. 26, 1985

[54] HIGH SPEED TEST TUBE AGITATOR APPARATUS

[75] Inventor: Rees D. Thomas, Lambertville, N.J.

[73] Assignee: Reese Scientific Corporation, Lambertville, N.J.

[21] Appl. No.: 577,488

[22] Filed: Feb. 6, 1984

[51] Int. Cl.[4] ..... B01F 11/00

[52] U.S. Cl. ..... 366/208; 74/86; 200/332; 366/601; 422/99

[58] Field of Search ..... 366/208, 209, 210, 211, 366/213, 216, 110, 111, 112, 601; 422/99; 74/86; 200/332, 333, 334, 153 T

[56] References Cited

U.S. PATENT DOCUMENTS

| | | | |
|---|---|---|---|
| 982,156 | 1/1911 | Miltz . | |
| 2,468,538 | 4/1949 | Benioff . | |
| 2,480,502 | 8/1949 | Nieder . | |
| 2,524,523 | 10/1950 | Greenberg . | |
| 2,846,201 | 8/1958 | Mermelstein . | |
| 3,061,280 | 10/1962 | Kraft et al. | 366/110 |
| 3,159,384 | 12/1964 | Davis | 74/86 X |
| 3,310,292 | 3/1967 | Moore . | |
| 3,346,241 | 10/1967 | Schubert . | |
| 3,401,034 | 9/1968 | Moore . | |
| 3,768,634 | 10/1973 | Creevy . | |
| 3,809,322 | 5/1974 | Hirosawa . | |
| 3,832,508 | 8/1974 | Beck | 200/332 |
| 3,850,580 | 11/1974 | Moore et al. . | |
| 3,975,001 | 8/1976 | Moore et al. | 366/209 X |
| 4,042,218 | 8/1977 | Moore et al. . | |
| 4,118,801 | 10/1978 | Kraft et al. | 366/111 |
| 4,202,634 | 5/1980 | Kraft et al. | 366/111 |
| 4,212,546 | 7/1980 | Porteous | 366/213 |

FOREIGN PATENT DOCUMENTS

| | | | |
|---|---|---|---|
| 922312 | 3/1963 | United Kingdom | 200/332 |
| 1199840 | 7/1970 | United Kingdom | 366/111 |
| 1240592 | 7/1971 | United Kingdom | 366/111 |

*Primary Examiner*—Philip R. Coe

*Attorney, Agent, or Firm*—Richard C. Woodbridge

[57] ABSTRACT

A laboratory mixer includes a test tube supporting cup means that translates in a circular path at high speed without rotating thereby creating an effective vortex in the materials in the test tube. A motor is mounted in the apparatus housing and supports a cylindrical metal block. The cylinder includes a circular cavity having a center located away from the axis of rotation of the motor and the cylinder itself. A pair of bearings located in the cavity support one end of a shaft that carries the test tube holding cup. The cup is allowed to translate in a circular path but is prevented from rotating by a restraining means that includes a restraining arm rotatably attached to the housing and a side arm connecting the restraining arm to the cup supporting shaft. The user rests the heel of his hand on a pressure sensitive touch plate while placing the closed end of the test tube in the cup. Pressure from the hand causes the touch plate to close a switch and automatically turn the mixer motor on. A counterweight acts to balance the vibratory effects of the eccentric cylinder. The invention allows difficult mixing and homogenizing operations to be performed at high speed.

17 Claims, 8 Drawing Figures

HIGH SPEED TEST TUBE AGITATOR APPARATUS

BACKGROUND OF THE INVENTION

1. Field of the Invention

The invention relates to a high speed laboratory mixer including a test tube supporting cup means which translates in a circle path but does not rotate while the mixing operation takes place.

2. Description of the Prior Art

It is common practice in laboratories to work with large numbers of samples in small plastic test tubes. The plastic test tubes have many advantages over old fashioned glass tubes. Modern plastic tubes have their own covers, are unbreakable, solvent resistant and fit into small powerful centrifuges.

Mixing operations are normally carried out in these plastic tubes in the same manner as described in the prior art by U.S. Pat. No. 3,061,280. The mechanism described in U.S. Pat. No. 3,061,280 is believed to work well at slow speeds (below 3,000 revolutions per minute) but it is not believed to be capable of powerful high speed agitation. Many instances arise in a laboratory where the mixing of intractable substances is desirable. For example, bacteria centrigued down into the bottom of the plastic test tube can be quite tightly packed and resistant to dispersion by the type of mechanism described in U.S. Pat. No. 3,061,280. According to that invention an eccentricly mounted collar drives a resilient cup in a circular path. An arm connects the cup to an elongated spring which serves to dampen vibrations and to prevent the mixing cup from rotating. It is believed that the oscillatory, harmonic characteristics of the damping mechanism prevent the device from operating at high speeds in the neighborhood of 10,000 revolutions per minute. Moreover, there are no hand-rest switches for automatically triggering the operation of the mixing device through the hand pressure of the machine operator. The invention described in this disclosure is capable of safe operation at speeds in excess of 10,000 revolutions per minute. This type of agitation is necessary in order to disperse tightly packed bacteria, homogenized immiscible liquids or tissues and accomplish other difficult mixing procedures.

The device described in U.S. Pat. No. 3,159,384 has an advantage over the device described in U.S. Pat. No. 3,061,280 in that more than one tube can be agitated at the same time. However, it is also believed to be incapable of high speed use since it employs the same type of eccentric drive and spring retaining mechanism as is found in other prior art agitators. Moreover, it also does not include or suggest the use of a hand rest-switch to provide for comfortable one-hand operation.

The device described in U.S. Pat. No. 3,850,580 is similar to the devices described in U.S. Pat. Nos. 3,061,280 and 3,159,384 except that spring wire rod members are used to prevent rotation and provide damping in place of elongated coil springs.

U.S. Pat. No. 3,975,001 describes a mixer employing an eccentric drive to propell a gimbal mounted mixing cup cylinder. A test tube is inserted into the cylinder which includes a spring loaded cup in the bottom thereof. The intensity of the mixing action is controlled by the depth to which the test tube is inserted into the mixing cylinder against the pressure of the spring loaded cup. That device is different from the invention described in this disclosure in that high speed operation is not believed to be obtainable and there is no provision for hand rest-switching of the mechanism.

Other relevant prior art patents of lesser importance include: Nos. 982,156; 2,468,538; 2,480,502; 2,524,523; 2,846,201; 3,310,292; 3,346,241; 3,401,034; 3,768,634; 3,809,322; 4,042,218; 4,118,801 and 4,202,634.

Insofar as understood, none of the prior art references describe an efficient, reliable high speed agitator capable of actuation by a hand-rest switch thereby allowing convenient one-handed operation.

SUMMARY OF THE INVENTION

Briefly described the invention comprises a mixer capable of efficient high speed operation and controllable through a hand-rest switch. A motor drives a heavy counter-balanced cylinder which includes an eccentrically located cavity on the top side thereof. The eccentrically located cavity carries a pair of ball bearings attached by a shaft to a mixing cup. When the motor is actuated the mixing cup is driven in a circular path but prevented from rotating by a restraining mechanism. The restraining mechanism comprises a pair of arms pivotally connected to the mounting plate of the motor. A cast iron housing preferably surrounds the drive mechanism. An aperture in the housing allows the mixing cup to extend beyond the drive mechanism. Activation of the device is controlled by a hand-rest switch. A pair of resiliently mounted hand-rest levers are attached to the housing and located in the proximity of the mixing cup. Pressure on the hand-rest levers actuates a limit switch which causes the agitator motor to turn on and off. The hand-rest lever allows the mechanism to be conveniently operated by simply resting one hand on the hand-rest levers. The mixing cup has a V-shaped interior cavity which is adapted to receive the tapered end of the test tube. A polyvinyl chloride coating covers the V-shaped cavity and helps to prevent test tube breakage.

Prior to operation the on-off switch is turned "on" thereby providing power to the motor. The preferred speed of the equipment is preset accurately by a solid state speed-regulated speed control. The machine operator then places the test tube in the mixing cup with his hand. Downward pressure from the heel of the same hand causes the motor to turn on and the mixing operation to begin. The high speed motor then translates the bottom of the test tube in a circular path resulting in a vortex mixing action within the test tube. The restraining arms prevent the mixing cup from rotating while processing in a circular path, thereby minimizing potential damage to the test tube. Since no springs are involved, there is minimal potential for damage from spurious harmonic oscillation. A counterweight on the eccentric drive cylinder further reduces undesirable vibrations. Operation of the mechanism automatically ceases when the heel of the operators hand is removed from the hand-rest switch levers.

These and other features of the invention can be further understood by reference to the following drawings.

DETAILED DESCRIPTION OF THE PREFERRED EMBODIMENT

During the course of this description like numbers are used to identify like elements in the different figures which illustrate the invention.

Figure 1:
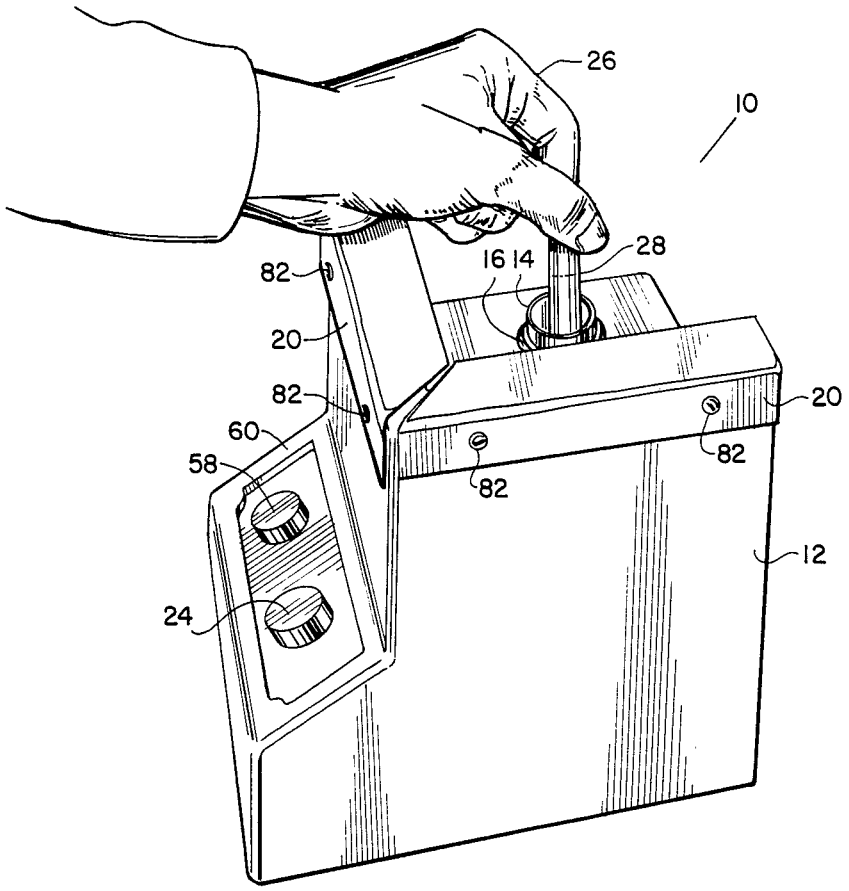
FIG. 1 is a perspective view of the preferred embodiment of the invention which also shows the manner in which the agitator operator initiates operation of the equipment.

As shown in FIG. 1 the agitator invention 10 is largely surrounded by a cast iron housing 12. An oscillating cup 14 protrudes through an opening 16 in the top of housing 12. A pair of hand-rest levers 20 are mounted on the housing 12 by screws 82 and grommets 22. The knob of a solid state speed control device 24 is used to adjust the mixing speed of the mechanism. Off-on switch 58 is used to control electric power from the power source to the agitator motor 34. The hand 26 of an operator is shown with its heel resting on hand-rest levers 20. The fingers of hand 26 hold a laboratory test tube 28 the base of which is received in the V-shaped depression 86 in cup 14. Heel pressure from hand 26 actuates a limit switch 18 which activates the agitating motion of oscillating cup 14 in a manner described later in this disclosure.

Figure 2:
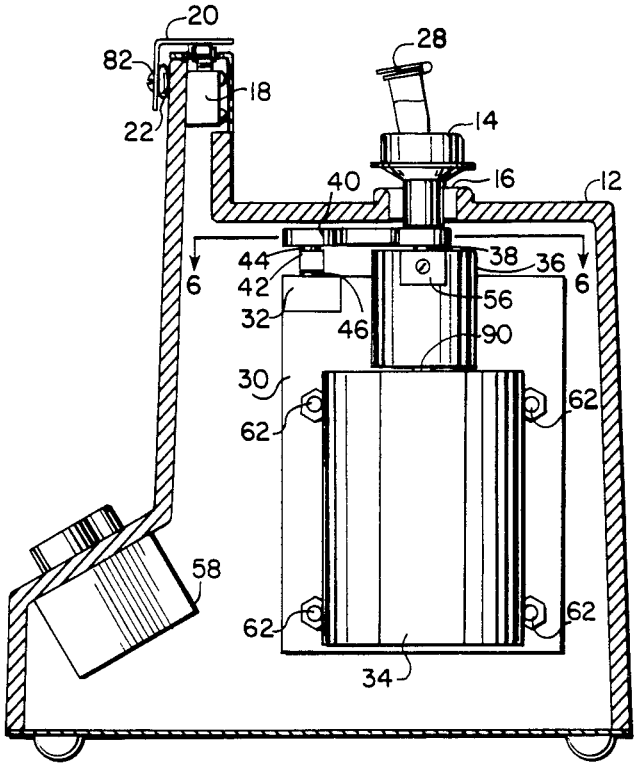
FIG. 2 is a partial cross-sectional elevational view of the preferred embodiment shown in FIG. 1.

FIG. 2 illustrates the manner in which the agitator motor 34 is supported by mounting plate 30 which in turn is attached to cast iron housing 12. Screws 70 secure motor 34 to mounting plate 30. Similarly resilient vibration mounts 62 serve to connect the mounting plate 30 to housing 12.

The agitator drive mechanism includes an eccentric cylinder 36 which is connected by motor shaft 90 to electric motor 34. Motor shaft 90 is received in the bottom aperture 94 of eccentric cylinder 36. Aperture 94 (shown in cross-sectional view of FIG. 5B) is located in the geometrical center of the bottom of cylinder 36. An eccentrically located aperture 92 is located on the top side of cylinder 36. Therefore rotation of shaft 90 causes aperture 92 to describe a circle as cylinder 36 rotates. Set screw 71 secures cylinder 36 to motor shaft 90. A counterweight 56 is also attached with a screw to eccentric cylinder 36 for the purpose of balancing the drive train and thereby preventing undesirable spurious oscillation.

Eccentrically offset opening 92 is large enough to receive an upper ball bearing 54 and a lower ball bearing 66 separated by a spacer collar 64. A shaft 38 passes through bearings 54 and 66 and spacer 64. Bearings 54 and 66 allow shaft 38 to rotate freely in cavity 92 as cylinder 36 is driven by motor 34. Shaft 38 is permitted to travel in a circle but is prevented from rotating at the same time by a restraining mechanism. The restraining mechanism comprises side arm 40; ball bearing 52; upper post 44; restraining arm 42; lower post 46; ball bearing 50 and fixed support 32. Fixed support 32 is rigidly attached to motor mounting plate 30. Ball bearing 50 is snuggly received in the aperture in fixed support 32. The lower post 46 of restraining arm 42 is received in ball bearing 50. Ball bearing 50 permits the restraining arm 42 to oscillate along a portion of the arc of a circle. Upper post 44 of restraining arm 42 is received in ball bearing 52 which is itself received in an aperture in one end of side arm 40. The other end of side arm 40 is attached by set screw 48 to the flat portion on vertical shaft 38. Likewise the lower aperture 96 of oscillating cup 14 fits over the top of shaft 38 and is secured thereto by a set screw 68 which engages the flat on the side of shaft 38. Therefore, cup 14 is restrained from rotating with respect to side arm 40 and shaft 38. However, the restraining mechanism which includes the side arm 40 and restraining arm 42 permits the cup 14 and the shaft 38 to process in a circular path.

Figure 3:
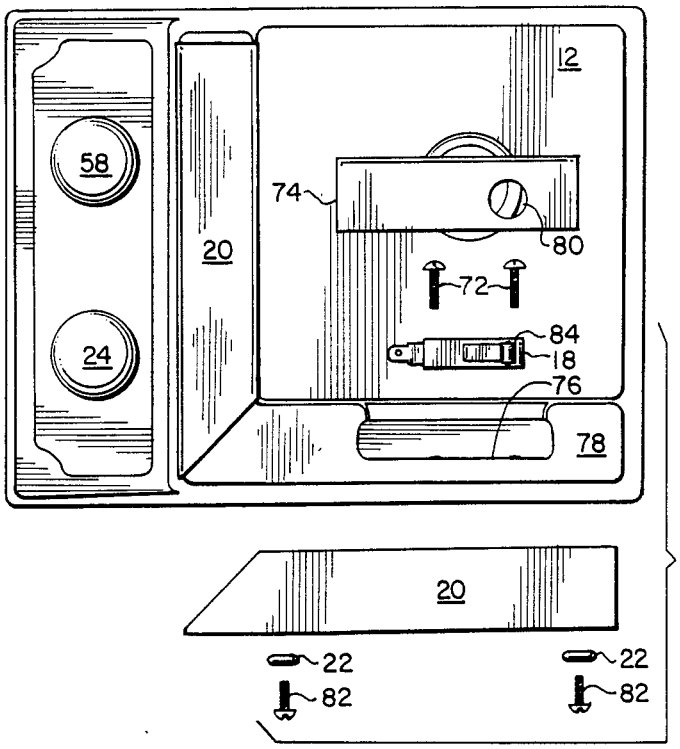
FIG. 3 is a partial exploded view of the hand-rest lever switch mechanism employed to turn the agitator on and off.
Figure 4:
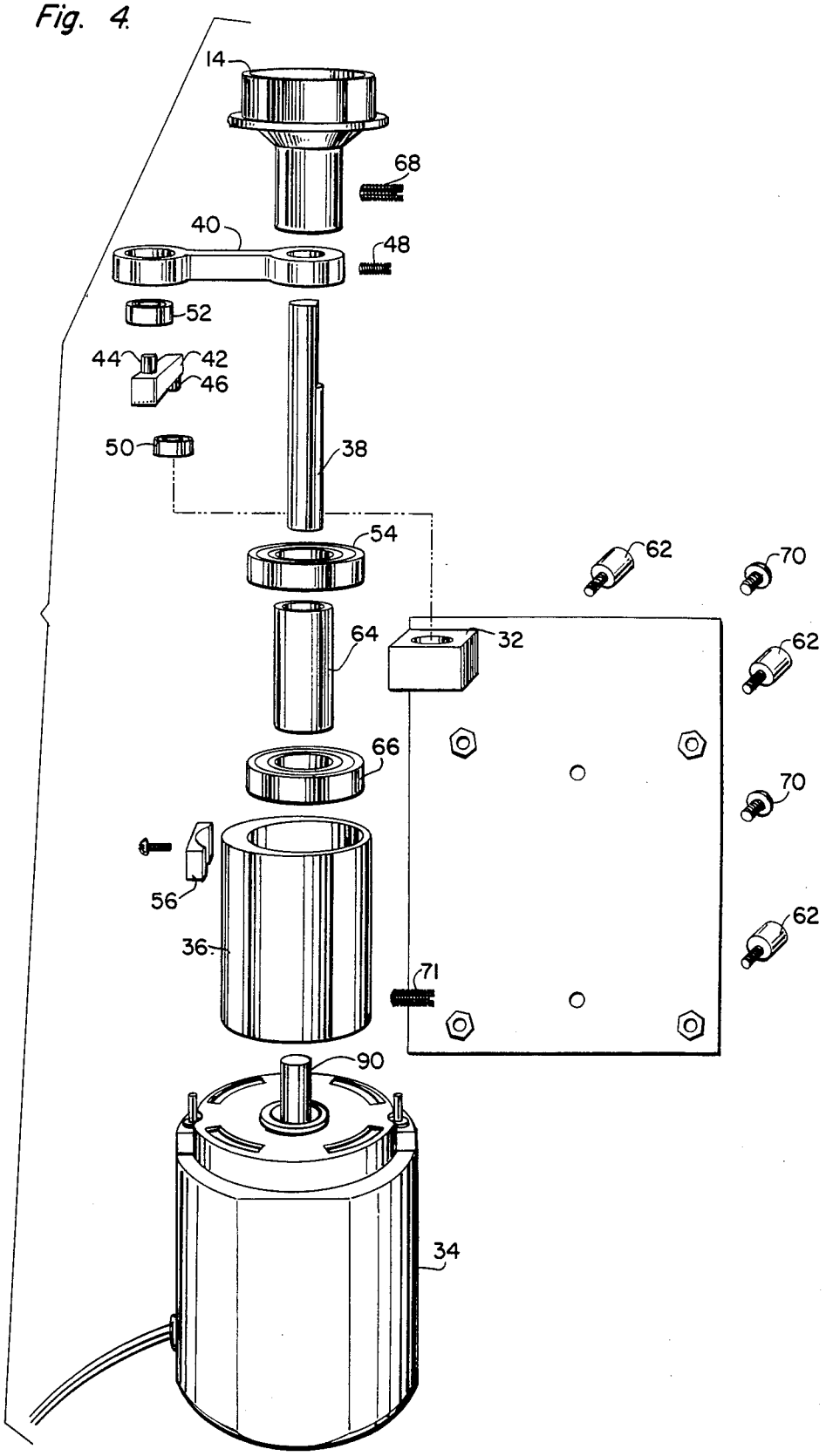
FIG. 4 is an exploded view of the drive mechanism of the agitator.
Figure 5A:
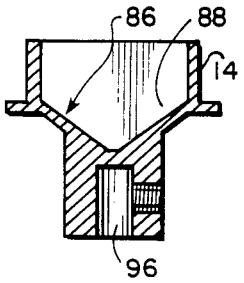
FIG. 5A is a cross-sectional view of the cup for supporting the base of the agitated test tube.
Figure 5B:
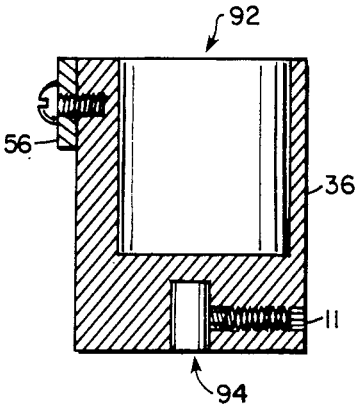
FIG. 5B is a cross-sectional view of the eccentric drive cylinder.
Figure 6A:
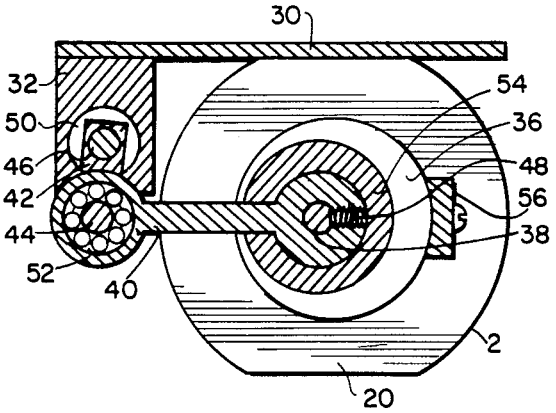
FIG. 6A is a cross-sectional view taken along plane 6—6 of FIG. 2 with the side arm of the restraining mechanism at its left-most position.
Figure 6B:
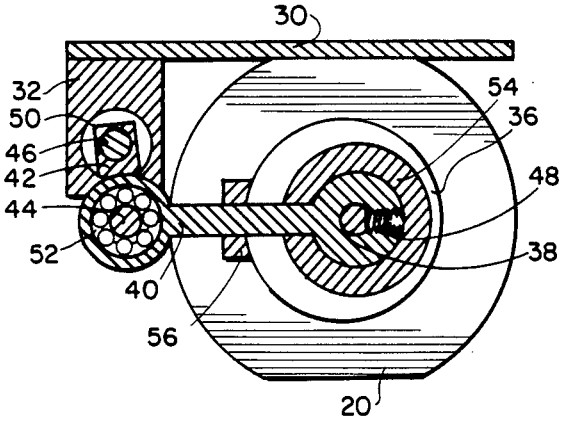
FIG. 6B is a cross-sectional view taken along plane 6—6 of FIG. 2 with the side arm of the restraining mechanism at its right-most position.

The manner in which the limit switches 18 are mounted on housing 12 is illustrated in FIG. 3. The two limit switches 18 are received respectively in depression 76 located on the interior top sides of housing 12. Mounting screws 72 hold the limit switches 18 in position. A decorative plate 74 is mounted over the limit switches 18 in such a manner that the rollers 84 of the limit switches 18 protrude through the opening 80 in the decorative plate 74. The rollers 84 protrude above the upper surface 78 of the casting 12 so that they make contact with the underside of hand-rest levers 20. Hand-rest levers 20 are resiliently attached to housing 12 by screws 82 and grommets 22. When there is no pressure on hand-rest levers 20 the limit switches 18 are normally off. However, when the agitator operator places the heel of his hand 26 on the hand-rest levers 20 the grommets 22 will flex and the levers 20 will exert a downward pressure on roller 84 causing the limit switch 18 to turn on. This in turn initiates the agitation action of the apparatus 10. A cross-sectional view of the mixing cup 14 is illustrated in FIG. 5A. The V-shaped groove 86 is located symmetrically in the center of the cup and is adapted to receive the base of the hand-held test tube 28. According to the preferred embodiment a polyvinyl chloride coating 88 covers the V-shaped groove 86 and helps to prevent abrasion of test tube 28 during high speed agitation.

Operation of the apparatus 10 is initiated by turning switch 58 on front panel 60 to the "ON" position. This provides electrical power to the device. Next the slid state speed-regulated controller 24 is set to the appropriate desired agitation speed. The operator then grasps the test tube 28 in the fingers of his hand 26 and places the test tube 28 in the V-shaped depression 86 of cup 14. The operator then rests the heel of hand 26 on one of the two hand-rest lever switches 20 causing it to depress the roller 84 of one of the limit switches 18. Activation of one of the limit switches 18 closes the electrical circuit thereby providing power directly to motor 34. Motor 34 causes shaft 38 to process in a circle. Since agitator cup 14 is connected to shaft 38 it also processes in a circle. However, cup 14 is constrained from rotating by side arm 40 and restraining arm 42. When agitation is complete the operator merely removes the heel of his hand 26 from the apparatus 10 thereby allowing the hand-rest lever 20 to return to its normal position which also reduces the pressure on roller 84. This in turn deactivates limit switch 18 causing the motor 30 to stop.

The present invention provides three major advantages over prior art agitators. First, the device is capable of very high speed operation in large part because it does not require a spring or similar device to constrain the agitator cup 14 from rotating. The present invention is capable of extremely high speeds of agitation without introducing unnecessary vibrations or other disturbances. These high speeds are especially desirable for modern applications where complete dispersion of biological agents is often necessary. Second, the present invention allows the agitator operator to operate the equipment with only one hand. This leaves the other hand free to do other things, such as adjust agitation speed, or agitate a second test tube at the same time.

The speed-regulated speed control allows accurate setting of agitation speed which improves reproducibility in experimental results.

There are some other modifications that might be possible. For example, resilient polymers other than polyvinyl chloride could be used to coat the V-shaped groove 86 of agitator cup 14. Moreover there may be some depressions, such as a U-shape that might work as an alternative for the V-shaped depression 86. The invention 10 has been described with respect to the use of two limit switches 18 and two hand-rest levers 20. The device could operate with only one limit switch 18 and one hand-rest lever 20 or, it could operate with more than two. It will also be appreciated that the solid state speed control 24 might be replaced by other mechanisms such as a variable speed transformer.

While the invention has been described with reference to the preferred embodiment thereof it will be appreciated by those of ordinary skill in the art that various changes can be made to the structure and elements which comprise the invention without departing from the spirit and the scope thereof.

I claim:

1. A high speed laboratory mixer apparatus comprising:

a motor;

eccentric means attached to said motor for describing a circular path;

bearing means attached to said eccentric means;

cup means attached to said bearing means for supporting the base of a labortory test tube; and, non-resilient restraining means attached to said cup means for allowing said cup to translate in a circular path while preventing said cup means from rotating.

2. The apparatus of claim 1 further comprising:

hand-rest means for supporting a hand holding a laboratory test tube while said test tube is in contact with said cup means.

3. The apparatus of claim 2 wherein hand-rest means comprises:

hand-rest lever means; and, switch means for contacting said hand-rest lever means, wherein the force of a hand resting on said hand-rest lever means causes said switch means to close and said motor to turn on.

4. The apparatus of claim 3 further comprising:

counterweight means attached to said eccentric means for minimizing the dynamic unbalance of said apparatus.

5. The apparatus of claim 4 wherein said eccentric means includes:

motor mounting means for attaching said eccentric means to said motor so that said eccentric means rotates around an axis of rotation; and, a cavity means having a center located away from said axis of rotation of said eccentric means for receiving said bearing means.

6. The apparatus of claim 5 wherein said retraining means comprises:

a first arm having a first end and a second end, said first end being connected to said cup means; and, a second arm having a first end and a second end, said first end of said second arm being rotatably attached to said second end of said first arm and said second end of said second arm being rotatably attached to a relatively nonmovable object.

7. The apparatus of claim 6 wherein said bearing means comprises:

a first bearing;

a second bearing; and, a spacer element between said first and second bearing.

8. The apparatus of claim 7 wherein said cup means further comprises:

a cup element; and, a first shaft having a first and a second end, said first end being attached to said cup element and said second end being connected to said bearing means.

9. The apparatus of claim 8 further comprising:

a third bearing for rotatably connecting said first arm to said first shaft.

10. The apparatus of claim 9 further comprising:

a fourth bearing means for rotatably connecting said second arm to said relatively nonmovable object.

11. The apparatus of claim 10 further comprising:

a housing means for housing and supporting said motor and said hand-rest means.

12. The apparatus of claim 11 wherein said cup element includes a V-shaped depression in the bottom thereof.

13. The apparatus of claim 12 further including:

a resilient polymer coating on the inside of said V-shaped depression.

14. The apparatus of claim 13 wherein said resilient coating comprises polyvinylchloride.

15. A high speed laboratory mixer apparatus comprising:

a motor;

eccentric means attached to said motor for describing a circular path;

bearing means attached to said eccentric means;

cup means attached to said bearing means for supporting the base of a laboratory test tube; and, restraining means attached to said cup means for allowing said cup means to translate in a circular path while preventing said cup means from rotating, said restraining means including a first arm having a first end and a second end, said first end of said first arm being connected to said cup means and a second arm having a first end and a second end, said first end of said second arm being rotatably attached to said second end of said first arm and said second end of said second arm being pivotally attached to a relatively non-movable object.

16. A high speed laboratory mixer apparatus comprising:

a housing;

a motor supported by said housing;

eccentric means attached to said motor for describing a circular path;

bearing means attached to said eccentric means;

cup means attached to said bearing means for supporting the base of a laboratory test tube;

movable hand pressure sensitive means supported by said housing and located above said cup means, said hand pressure sensitive means including a switch means also supported by said housing for responding to the pressure of a hand on said movable hand pressure sensitive means; and, non-resilient restraining means attached to said cup means for allowing said cup means to translate in a circular path while preventing said cup means from rotating, wherein the force of a hand holding a laboratory test tube and resting on said hand pressure sensitive means causes said switch means to close and said motor to turn ON.

17. The apparatus of claim 16 wherein said movable hand pressure sensitive means includes:

hand-rest lever means; and, switch means for contacting said hand-rest lever means, wherein the force of a hand resting on said hand-rest lever means causes said switch means to close and said motor to turn ON.

* * * * *